219-121
9/22/87 XR 4,694,990 SR

United States Patent [19]

Karlsson et al.

[11] Patent Number: 4,694,990

[45] Date of Patent: Sep. 22, 1987

[54] THERMAL SPRAY APPARATUS FOR COATING A SUBSTRATE WITH MOLTEN FLUENT MATERIAL

[76] Inventors: Axel T. Karlsson, 94 Townsend Dr., Middletown, N.J. 07748; Mille Stand, Apt. 4A, 117 S. Highland Ave., Ossining, N.Y. 10562

[21] Appl. No.: 818,182

[22] Filed: Jan. 13, 1986

Related U.S. Application Data

[63] Continuation-in-part of Ser. No. 648,070, Sep. 7, 1984, abandoned.

[51] Int. Cl.[4] ..... B05B 1/24

[52] U.S. Cl. ..... 239/81; 219/76.16; 219/121 PL; 239/85; 239/132; 239/135

[58] Field of Search ..... 239/79, 80, 86, 131, 239/133, 135, 139, 136, 137, 423, 416.5, 81, 85; 431/353, 242; 427/422; 118/302; 219/121 PL, 121 PM, 121 PR, 76.16

[56] References Cited

U.S. PATENT DOCUMENTS

| | | | |
|---|---|---|---|
| 1,588,503 | 6/1926 | Spigelmire | 239/139 |
| 2,219,917 | 10/1940 | Crosiar | 239/133 |
| 2,857,961 | 10/1958 | Brown, III et al. | 431/353 |
| 2,861,900 | 11/1958 | Smith et al. | 118/302 |
| 3,935,418 | 1/1976 | Stand et al. . | |
| 4,012,189 | 3/1977 | Vogt | 431/242 |
| 4,021,188 | 5/1977 | Yamagishi et al. | 431/353 |
| 4,065,057 | 12/1977 | Durmann | 239/133 |
| 4,347,982 | 9/1982 | Wright | 239/423 |
| 4,416,421 | 11/1983 | Browning | 239/79 |
| 4,540,121 | 10/1985 | Browning | 239/81 |

FOREIGN PATENT DOCUMENTS

| | | | |
|---|---|---|---|
| 1320809 | 6/1973 | United Kingdom | 239/79 |

*Primary Examiner*—Andres Kashnikow
*Assistant Examiner*—Michael J. Forman
*Attorney, Agent, or Firm*—R. Gale Rhodes, Jr.

[57] ABSTRACT

Thermal spray apparatus for providing a stream of molten fluent material for coating a substrate, including a heat source including a flame for producing a stream of heated gas heated to sufficiently high temperature to melt the material; material advancing means for advancing a stream of heat fusible fluent material into the stream of heated gas to melt the material and produce the stream of molten fluent material; and a flame barrier intermediate the flame and the stream of molten fluent material for preventing reaction between the flame and the material, the flame barrier permits passage therethrough of the stream of heated gas.

11 Claims, 12 Drawing Figures

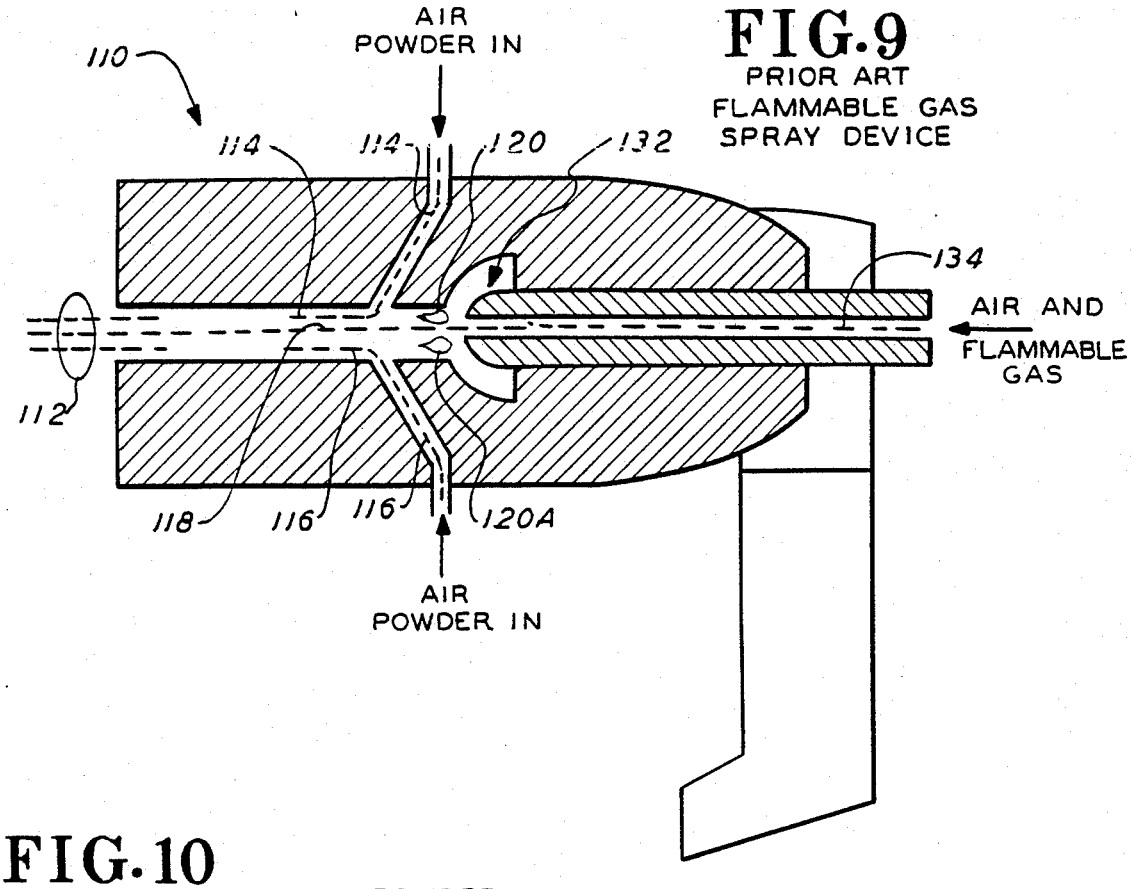
FIG. 9
PRIOR ART
FLAMMABLE GAS
SPRAY DEVICE
FIG. 10
PRIOR ART
PLASMA SPRAY
DEVICE
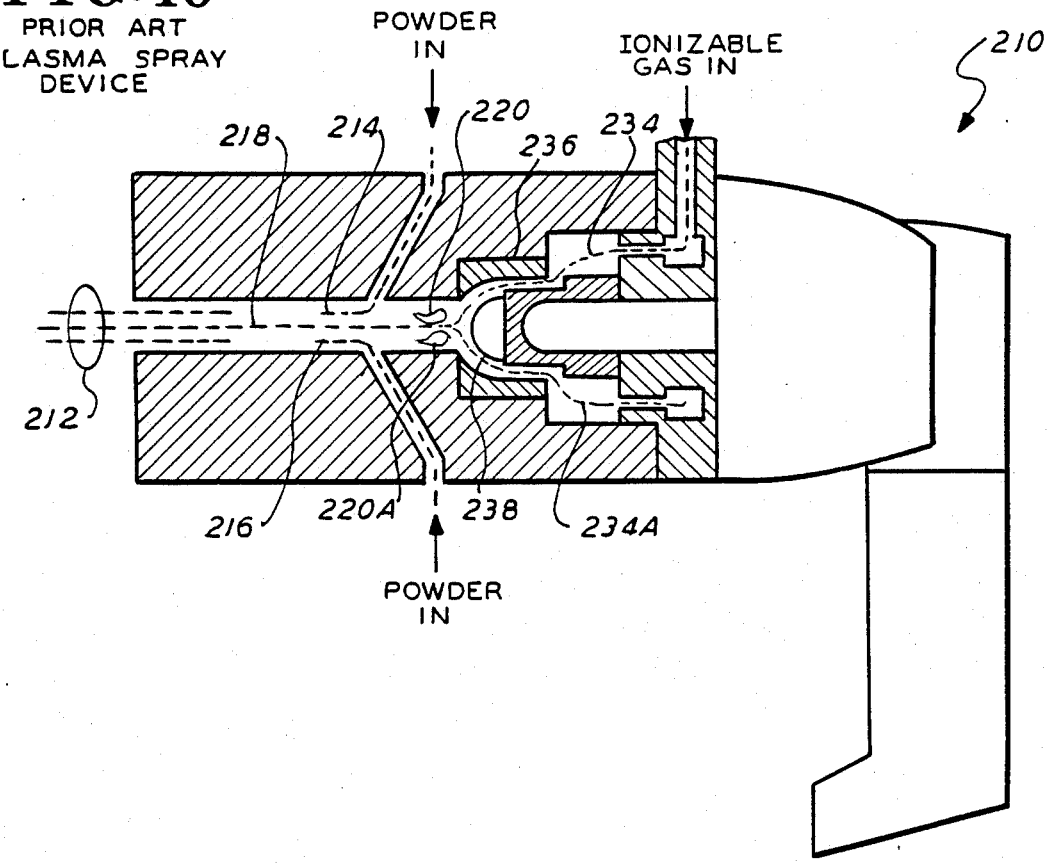

THERMAL SPRAY APPARATUS FOR COATING A SUBSTRATE WITH MOLTEN FLUENT MATERIAL

CROSS REFERENCE TO RELATED APPLICATION

This application is a continuation-in-part of pending U.S. patent application Ser. No. 06/648,070 filed Sept. 7, 1984 now abandoned.

BACKGROUND OF THE INVENTION

This invention relates to improved apparatus for coating a substrate with molten fluent material and in particular relates to apparatus referred to in the context of this application and the appended claims as thermal spray apparatus for producing a ray or stream of molten fluent material with which the substrate is sprayed and which material upon hardening provides the substrate with a coating of the material.

It will be understood by those skilled in the art that as used in the context of this specification and the appended claims, the term "ray" or "stream" is used in the sense of a stream of particles traveling in the same line, the expression "heat fusible fluent material" is used to mean powdered or flowable thermoplastic and thermosetting material such as PTFE, e.g. Teflon, ® epoxies, polyester, polyurethane, polyvinylchloride, polyethylene and the like, the expression "molten fluent material" is used in the sense of being heated to its melting point prior to or simultaneously with striking the substrate, the term "substrate" is used to mean the surface of the object to be coated, and the term "flame" is used to means the result of combustion of an inflammable gas or a stream of gas undergoing combustion and the term "flame" in the context of this specification and the appended claims is also used to mean the arc struck between two electrodes between which an ionizable gas passes to effect or produce a plasma.

As known to those skilled in the art of coating substrates with fluent material, there is a great need for improved coating apparatus for coating large and stationary structures or substrates such as metal tanks, large construction substrates such as the roof of a tunnel, pipeline supports, pipelines, and other structures or objects that are too large to be coated by the conventional oven coating method wherein the object or structure must be sufficiently small to permit being placed inside an oven for pre-heating and whereafter the object of structure is coated with fluent material such as plastic and then re-inserted into the oven for post-curing. Presently, as is known, there is a great need for both initial coating and maintenance coating of such large objects or structures but the inconvenience and excessive cost of dismantling such large objects to permit insertion and re-insertion into an oven virtually prohibits oven coating of such large objects.

As is further known to those skilled in the art, wooden, cloth and paper substrates cannot be subjected to coating with fluent materials such as the above-noted plastic materials in the conventional oven heating method because these products or substrates deteriorate and present such a outgassing problem that oven coating would be rendered virtually useless. As is still further known to those skilled in the art, piece parts such as glass bottles, tin cans, or food packaging, which are required to be coated in large numbers per unit of time, cannot be coated in a cost-effective manner in the above-noted conventional oven heating method.

The use of the conventional "fluidized bed" coating method is, of course, known to the art, but such coating method requires that the substrates be heated to melt the fluent materials applied thereto and this preheating requirement has the attendant temperature deterioration and outgassing problem noted above, particularly with regard to wooden, cloth or paper substrates. In addition, the coating of the above-noted articles at large numbers per unit of time by the fluidized bed method has the intrinsic problem of article handling which is both time consuming and expensive whether done manually or by automation.

The "electrostatic spray" coating method is also known to the art and may be employed either with or without pre-heating of the substrate since the electrostatic charge holds the coating material on the substrate until it is used and, in the case of thermosetting material, the coating with the electrostatic spray obviously requires the substrate to be post-cured. Also, electrostatic spray apparatus is expensive, not readily portable, and does not lend itself to coating of the large substrates noted above.

The concept of "flame spraying" or "hot spray" has existed for some time as an alternative to circumvent the problems noted above with regard to the prior art coating methods and apparatus and has been conceived as a method wherein the heating source quickly, for example in a second or less, melts the fluent material such as one of the above-noted plastic materials and maintains the material in a molten state until applied to the substrate where the material will harden immediately but yet will remain in a plastic state sufficiently long to provide a homogeneous film or coating. The major advantage of such flame spraying or hot spray coating is that the substrate is subjected to very little heat whereby the above-noted problems with regard to substrate deterioration and outgassing it overcome. Further, such flame spraying is readily suitable for coating large objects or structures of the type noted above as they exist as there would be no dismantling or disassembly requirement for coating.

At present, at least insofar as is known, two approaches to flame spraying or hot spray coating have been used. One utilizes a heat source similar to a blow torch or welding torch and uses acetylene and oxygen as fuel. The limited success of this coating method is generally attributed to the prior art problem or difficulties of introducing finely ground plastic or powder, heat fusible fluent material, directly into, or at least near, the open flame to produce a stream of molten fluent material without causing combustion or oxidation of the material or reaction (i.e. chemical reaction) between the flame and material, which greatly reduce the integrity or homogeneity of the coating or film applied to a substrate. This prior art problem is typified by the handheld thermal spray or flame spraying apparatus 110 shown diagrammatically in FIG. 9 which produces a stream of molten fluent material illustrated collectively by dashed lines 112 by introducing a stream or streams of heat fusible fluent material indicated by dashed lines 114 and 116 into a stream of heated gas indicated diagrammatically by dashed line 118, which stream of heated gas is produced by the combustion or burning with an open flame, indicated diagrammatically at 120 and 120A, in a burner 132 of a stream of air and inflammable gas indicated by dashed line 134. Since there is no barrier intermediate the flame 120 and 120A and the heat fusible fluent material, reaction, i.e. chemical reaction, can occur between the flame and material causing the above-noted prior art problem.

The other flame spraying or hot spray coating method is referred to in the art as "plasma spraying," and is typified by the flame spraying apparatus and method disclosed in U.S. Pat. No. 3,935,418 issued Jan. 12, 1976 to Mille Stand et al. The advantage of this plasma method over the other method noted above (inflammable gas) is that a reducing atmosphere is created and consequently less coating material is oxidized. The appearance of the plasma can be compared to a high heat cutting torch such as the above-noted acetylene cutting torch where, in order to be effective, the fluent material must be introduced directly into the plasma, or at the border thereof, and hence into a least close proximity to the arc (flame) in order to melt the material into a molten state for coating. This prior art problem is typified by the hand-held plasma thermal spray apparatus or device 210 shown diagrammatically in FIG. 10 which produces a stream of molten fluent material illustrated collectively by dashed lines 212 by introducing a stream or streams of heat fusible fluent material indicated by dashed lines 214 and 216 into a stream of heated gas (plasma) indicated diagrammatically by dashed line 218 which stream of heated gas (plasma) is produced or effected by passing a stream, or streams, 234 and 234A of ionizable gas between two electrodes, anode 236 and cathode 238, to produce or effect the plasma 218. Again, since there is no barrier intermediate the arc (flame) 220 and 220A, and the heat fusible fluent material 214–216, and the stream of molten fluent material 212, reaction, i.e. chemical reaction, can occur between the arc (flame) and material causing the aforenoted prior art problems of material combustion, oxidation, etc.

Accordingly, there exists a need in the coating art of new and improved coating apparatus which overcomes the above-noted problems attendant to the noted prior art coating apparatus and in particular a new and improved invention which solves the problem of reaction between the flame and material, material combustion and oxidation associated with the prior art requirement of introducing the fluent material directly, or nearly directly, into the flame. Further, there exists a need for new and improved coating apparatus which is relatively inexpensive, readily portable, whereby it may be easily and inexpensively moved from one location to another and in particular be used to coat large objects and structures of the type noted above without requiring their dismantling or disassembly and which may also be readily used to coat articles in large number per unit of time of the type also noted above.

SUMMARY OF THE INVENTION

The thermal spray coating apparatus of the present invention overcomes the above-noted prior art problems and satisfies the noted coating need by providing a heat source including a flame which produces a stream of heated gas heated to sufficiently high temperature to melt a stream of heat fusible fluent material and produce a stream of molten fluent material; material advancing means are provided for advancing the stream of heat fusible material into the stream of heated gas; and a flame barrier is provided intermediate the flame and the stream of molten fluent material to prevent reaction between the flame and the material, the flame barrier permits passage therethrough of the stream of heated gas.

DESCRIPTION OF THE DRAWINGS

FIG. 9 is a diagrammatical illustration, in side elevational view, in cross-section, of prior art inflammable gas thermal spray apparatus or device;

FIG. 10 is a diagrammatical illustration, in side elevational view, in cross-section, of a prior art plasma thermal spray apparatus or device;

DESCRIPTION OF THE PREFERRED EMBODIMENTS

Figure 1:
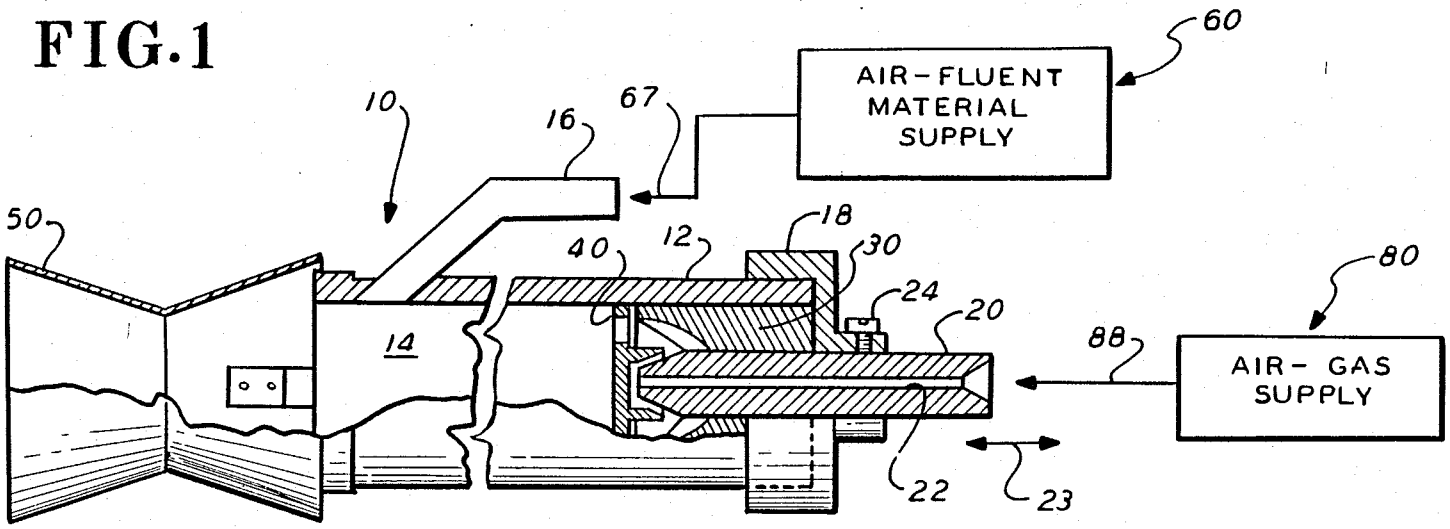
FIG. 1 is a diagrammatical illustration, in partial cross-section, of thermal spray coating apparatus embodying the present invention.

Referring now to FIG. 1, there is illustrated diagrammatically themal spray apparatus embodying the present invention and identified by general numerical designation 10. The thermal spray apparatus 10 may include a generally cylindrical housing 12, an air-gas nozzle 20, a burner or heat capacitor 30, a baffle or flame barrier 40 and a generally cylindrical spray nozzle 50. The housing 12 provides a central heat chamber 14 and extending from the upper portion of the housing 12 is a conduit 16. The conduit 16 is connected to an air-fleunt material supply 60 as illustrated diagrammatically and which air-fluent material supply is shown schematically and more fully in FIG. 3. Connected to the rear of the air-gas nozzle 20, as illustrated diagrammatically, is an air-gas supply 80 illustrated schematically and more fully in FIG. 2. It will be understood generally that the thermal spray apparatus 10 is for producing a column or stream of heated air or gas, produced as described below, which moves through the heat chamber 14 and into which is introduced a flow or stream of heat fusible fluent material from supply 60 which fluent material is heated by the moving column or stream of heated air or gas to produce a ray or stream of molten fluent material which passes through and is directed against a substrate (not shown) by the spray nozzle 50 to spray the substrate with the molten fluent material. The rear of the housing 12 is closed by the cap 18 provided with a central aperture through which the air-nozzle 20 extends.

Figure 2:
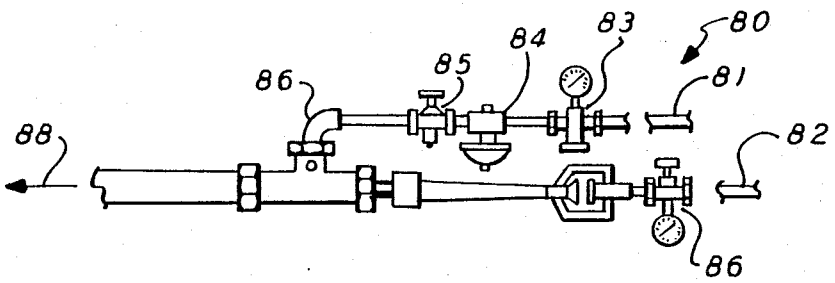
FIG. 2 is a schematic illustration of air-gas supply apparatus.

The air-gas supply, indicated by general numerical designation 80, is shown in greater detail in FIG. 2. This supply is for being connected to a suitable source of gas (not shown) by the partially shown gas line 81 and to a suitable source of pressurized air (not shown) by the partially shown air line 82. The air-gas supply 80 may include a gas pressure regulator 83, a zero governor 84, a gas cock 85, and an air regulator 86. As indicated by the arrows 88—88 in FIGS. 1 and 2, the air-gas supply 80 is for being connected to the rear end of the air-gas nozzle 20.

Figure 3:
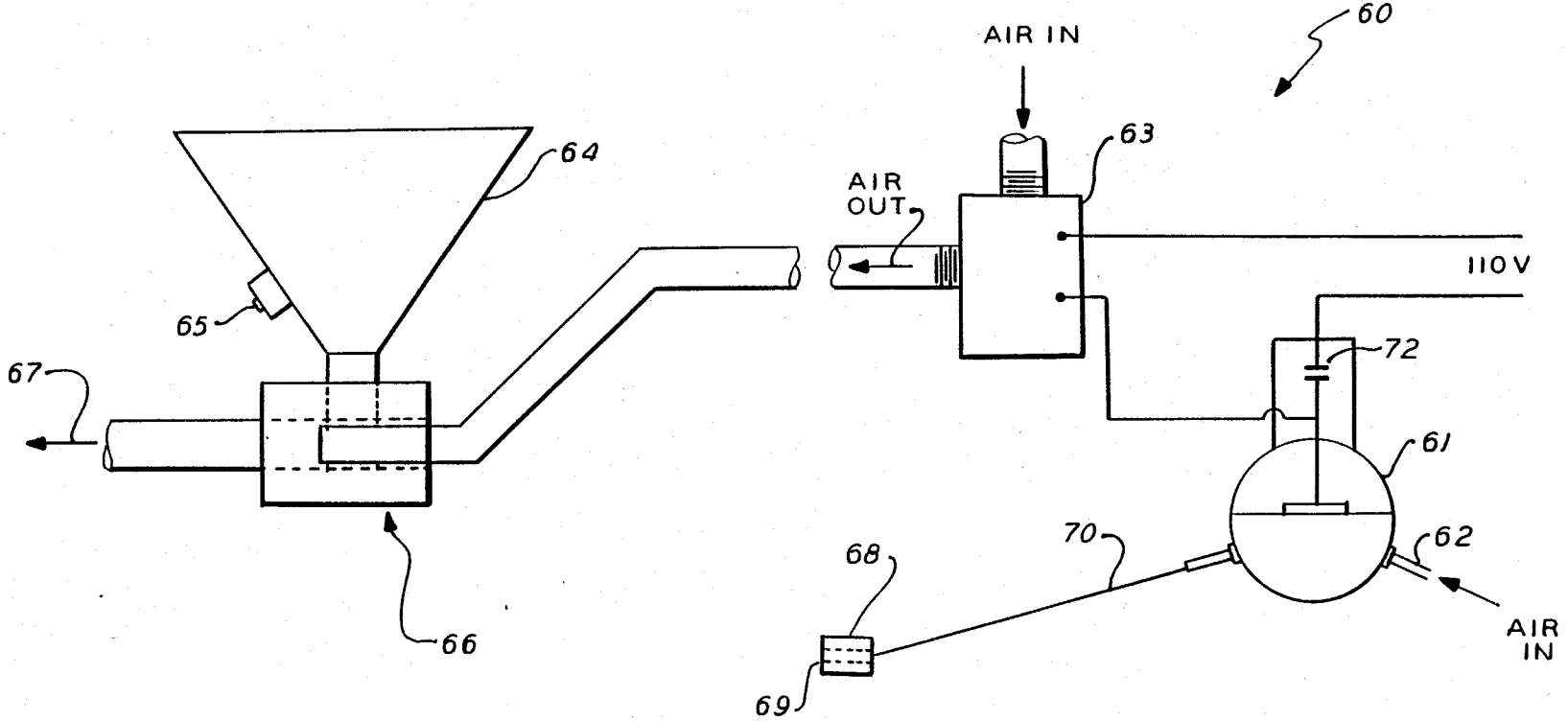
FIG. 3 is a schematic illustration of air-fleunt material supply apparatus.

Referring now to FIG. 3, the air-fluent material supply indicated by general numerical designation 60 will be described. This supply includes a bellows 61 connected to a suitable supply of pressurized air (not shown) by line 62, an electrically operated air solenoid valve 63 connectable through a normally open switch 72 to a suitable source of electrical energy as shown, a fluent material hopper 64, to which may be connected a vibrator 65 for agitating and facilitating dispensing of the fluent material from the hopper, and a fluent material valve 66. The output of the air-fluent material supply 60 is connected to the conduit 16 (FIG. 1) as indicated by the arrows 67—67 of FIGS. 3 and 1. Control of the air-fluent material supply 60 is provided by a control member 68 provided with an aperture 69 which communicates with the interior of the bellows 61 through line 70. Upon the aperture 69 being open, the pressurized air input to the bellows 61 over line 62 escapes through the aperture 69, the switch 72 remains open, and the air-fluent material supply is rendered inoperative. For operation, the aperture 69 is closed (manually or by other suitable mechanical means) which causes air pressure to build up in the bellows 61 closing the switch 72 thereby energizing and opening the air solenoid valve 63 to communicate pressurized air to the Venturi valve 66. The hopper 64 and vibrator 65 may be activated by suitable means (not shown) to dispense fluid material into the pressurized air flowing through the Venturi valve 66 whereupon the flow of fluent material is introduced through the conduit 16 (FIG. 1) into the heat chamber 14 and into the column or stream of heated gas or air moving through the chamber and out the spray nozzle 50.

Referring again to FIG. 1, and in particular to FIGS. 4–8, a detailed description of the structure and function of the airnozzle 20, burner or heat capacitor 30 and baffle or flame barrier 40 will now be set forth. The air-nozzle 20 is generally cylindrically shaped and provided with a central aperture or passageway 22 through which the air-gas mixture from the air-gas supply 80 flows and provided with a front end of generally truncated conical shape as shown. The front end provides a generally outwardly extending and radially disposed outer surface 24, FIG. 4. As may be best seen in FIG. 1, the air-gas nozzle 20 extends through the central aperture formed in the cap 18 and through the central aperture or passagway 32 (FIG. 5) formed centrally through the burner or heat capacitor 30. The air-nozzle 20 is mounted adjustably for forward and rearward movement, in the directions indicated by the double-headed arrow 23 in FIG. 1, to position the air-gas nozzle at various internal positions with respect to the burner or heat capacitor 30 and baffle or flame barrier 40. Once positioned, the air-gas nozzle 20 may be suitably locked in position by the set screw 24 shown in FIG. 1.

The burner or heat capacitor 30 and baffle or flame barrier 40 may be suitably mounted fixedly within the housing 12 by a suitable adhesive or by other positioning means known to those skilled in the art. As may be best seen from FIGS. 5 and 6, the burner or heat capacitor 30 is generally cylindrically shaped, provided with the above-noted central aperture 32, and provided at its face or forward end 33 with a plurality of radially disposed concave or inwardly extending slots or slits 36 (FIG. 6) providing, in combination, a generally concave region or face portion indicated by general numerical designation 37 in FIG. 5. The burner or heat capacitor 30 may be of any suitable shape in accordance with the teachings of the present invention thereby providing an improved and more efficient heat transfer.

Figure 4:
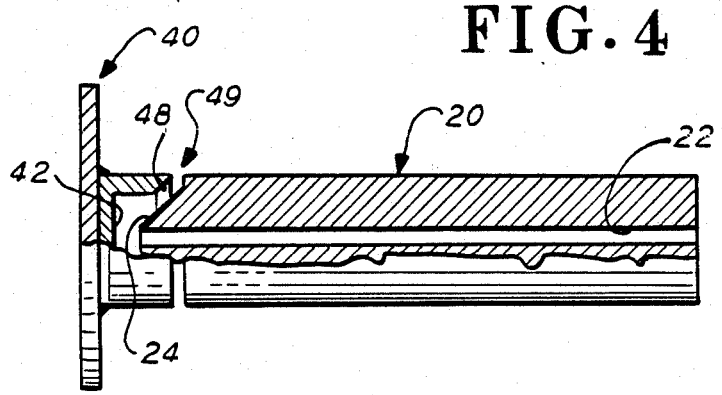
FIG. 4 is a side elevational view, in partial cross-section, of the air-gas nozzle and baffle of the present invention.
Figure 6:
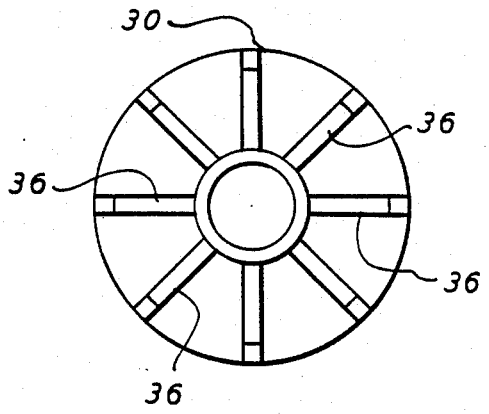
FIG. 6 is a front elevational view of the burner of FIG. 5.
Figure 5:
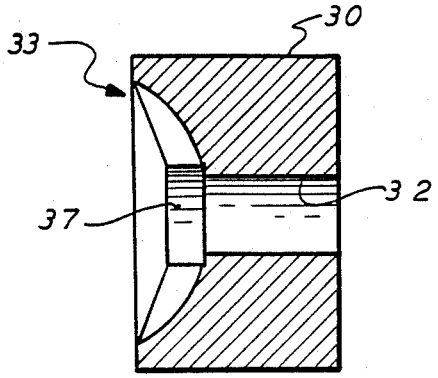
FIG. 5 is a side elevational view, in cross-section, of the burner of the present invention.
Figure 8:
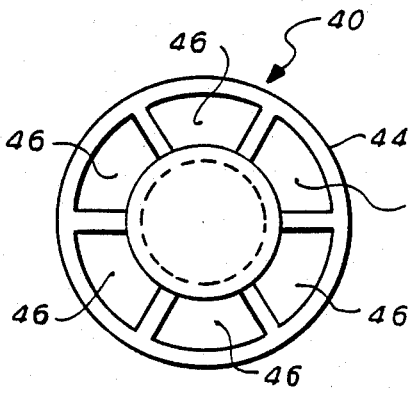
FIG. 8 is a front elevational view of the baffle of FIG. 7.
Figure 7:
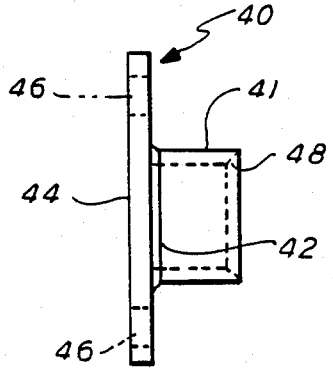
FIG. 7 is a side elevational view of the baffle of the present invention.

As may be best seen in FIGS. 4, 7 and 8, the baffle or flame barrier 40 is provided with a generally cylindrical or annular rearward portion 41 of substantially the same outer diameter as the air-gas nozzle 20, a solid central portion 42, and a forward disc-like or circular portion 44 of a larger diameter substantially equal to the inner diameter of the housing 12 of FIG. 1. The disc-like portion 44, as may be seen in FIG. 8, is provided with a plurality of radially disposed or annularly arranged apertures 46 extending therethrough. The rearward edge of the rearward cylindrical portion 41 of the baffle of flame barrier 40 is beveled, or extends radially inwardly, providing a generally inwardly extending and radially disposed inner surface 48. The inner surface 48 and the surface 24a of the air-gas nozzle 20 form, cooperatively and as may be best seen in FIG. 4, a generally radially outwardly and rearwardly extending annular passageway 49 through which air and gas flowing through the aperture 22 of the air-gas nozzle 20 is diverted by the solid central baffle or flame barrier portion 42 into the concave region or face portion 37 of the burner 30. It will be further understood that the adjustably mounted air-gas nozzle 20 may be moved forwardly or rearwardly to vary, open or close, the passageway 49.

The start-up procedure and operation of the thermal spray apparatus 10 of the present invention is as follows. Referring to FIG. 2, a valve (not shown) for the gas line 81 is opened, the gas pressure regulator 83 is set to a predetermined pressure (e.g. 8–11 psi), the gas cock 85 is opened and the air regulator 86 is opened and set to a predetermined pressure (e.g. 40 psi). A supply of air and gas is now flowing through the central aperture 22 of the air-gas nozzle 20 and through the radial passageway 49 into the concave region 37 of the burner or heat capacitor 30 and through the radially disposed apertures 46 of the baffle or flame barrier 40 through the heat chamber 14 and out the spray nozzle 50 where the gas may be suitably ignited manually or automatically in a manner known to those skilled in the art if desired. Initially an open flame is created whereafter the air and gas supplies are suitably adjusted by the gas pressure regulator 83 and air regulator 86, respectively, to trim the open flame until a flameless (i.e. not visible) glowing white heat source is provided at the concave portion or region 37 of the burner or heat capacitor 30. At this time, a column or stream of heated air or combustion gas (heated for example in the range of to 1,000° and above is flowing through the baffle or flame barrier aperture 46 (FIG. 8) through the heat chamber 14 and spray nozzle 15 and, at this time, the air-fluent material supply apparatus 60 (FIG. 3) is operated as described above to introduce at the heat chamber 14 (FIG. 1) a flow of fluent material into the moving column of heated air to heat the fluent material to produce a ray or stream of molten fluent material flowing through the spray nozzle 50. The ray or stream of molten fluent material may be directed by the spray nozzle 50 against a substrate to spray the substrate with the molten fluid material which, upon hardening, provides the substrate with a coating of the material; the spray nozzle may be provided with an intermediate portion of reduced diameter as shown in FIG. 1 to facilitate the focusing of the ray of fluent material.

With regard to the material of the various components of the thermal spray apparatus of the present invention, the air-gas nozzle 20 and baffle or flame barrier 40 may be made of suitable metal, such as mild steel, the burner or heat capacitor 30 may be made of a suitable refractory or ceramic material, the housing 12 may be made of a suitable metal such as stainless steel or of ceramic, and the spray nozzle 50 may be made of a suitable metal or ceramic and may be mounted at the front end of the housing 12 by suitable means depending upon the respective materials of which the housing 12 and spray nozzle 50 are made.

Referring again to the flameless (i.e. not visible) heat source of the present invention as described above as being produced by the burner or heat capacitor 30 in conjunction with the air-gas nozzle 20 and baffle or flame barrier 40, it will be understood that such flameless (i.e. not visible) heat substantially reduces oxidation of the fluent material; however, if desired an inert shielding gas such as nitrogen may be introduced into the gas supply to further reduce or limit oxidation of the fluent material. Also, the flameless (i.e. not visible) heat source of the present invention causes the present invention to have the ability to apply coatings to substrates which are temperature sensitive. Additionally, it will be recognized that the thermal spray apparatus of the present invention may be used to coat non-conductive substrates.

It will be understood by those skilled in the art that the thermal spray apparatus of the present invention may be operated manually, automatically and/or as part of a multiple coating system using, e.g. a common (manifold) system to apply two or more thermal spray devices.

Figure 11:
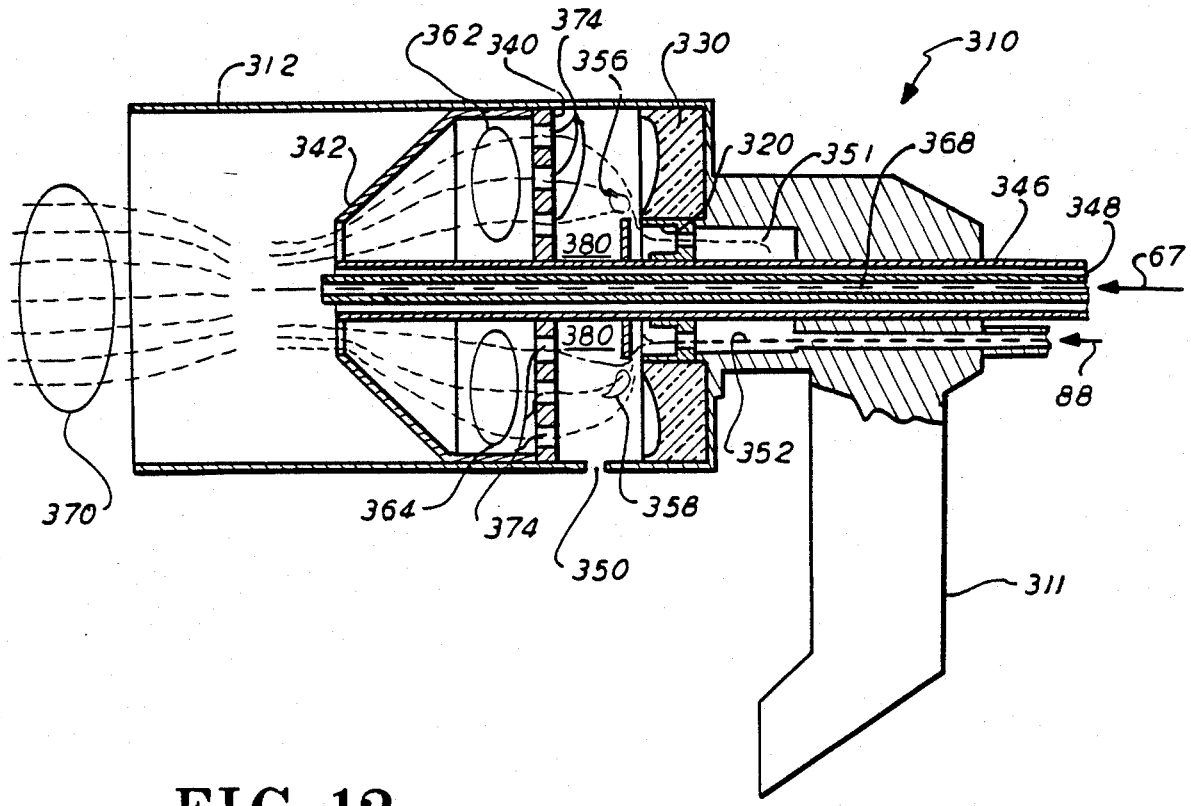
FIG. 11 is a diagrammatical illustration, in side elevational view, in cross-section, of an alternate embodiment of thermal spray apparatus embodying the present invention utilizing a stream of heated gas produced by combustion of inflammable gas.

Referring now to FIG. 11, there is shown a further embodiment of thermal spray apparatus embodying the present invention, which thermal spray apparatus is substantially similar to thermal spray apparatus 10 of FIG. 1 above and which in FIG. 11 is identified by general numerical designation 310. Thermal spray apparatus 310 is, as shown, a hand-held device or apparatus in this embodiment, including a handle 311, a housing 312, a burner indicated by general numerical designation 320, a heat capacitor 330, a first internal baffle or flame barrier 340, a second internal baffle 342, a pair of concentric tubes 346 and 348, and an ignition port 350; it will be understood, and as shown in cross-section, that the housing 312, burner 320, heat capacitor 330, a first internal baffle or flame barrier 340, second internal baffle 342 and the pair of concentric tubes 346 and 348 are substantially of cylindrical or annular shape or configuration and that the pair of concentric tubes 346 and 348 extend centrally through the other identified structural elements as illustrated in FIG. 11.

Referring still to FIG. 11, it will be understood that the burner 320, upon ignition of the stream or streams of air-flammable gas indicated by dashed lines 351 and 352 from a suitable source, such as source 80 of FIGS. 1 and 2, flame indicated diagrammatically at 356 and 358 is produced and the air-flammable gas mixture is burned to produce a stream of heated gas indicated collectively by the dashed lines 362 and 364 heated to sufficiently high temperature to melt a stream of heat fusible fluent material, indicated by dashed line 368, from a suitable source of air-fluent material, such as source 60 of FIGS. 1 and 3, which stream of heat fusible fluent material passes internally of the inner concentric tube 348 as shown. As illustrated diagrammatically in FIG. 11, the stream of heat fusible fluent material is advanced into the stream of heated gas 362 and 364 to melt the material and produce a stream of molten fluent material indicated collectively by dashed lines 370; the stream of molten fluent material 370 is for being directed or sprayed onto a substrate and upon hardening coats the substrate as described above.

It will be understood that the flame barrier 340 is substantially similar to the baffle or flame barrier 40 of thermal spray apparatus 10 of FIG. 1, shown in greater detail in FIG. 8, and that the baffle or flame barrier 340 is provided with a plurality of annular arranged or radially disposed apertures 374 which, it will be understood, are sufficiently large to permit passage therethrough of the stream of heated gas 362 and 364 but are sufficiently small to prevent the flame 356–358 from penetrating or passing therethrough and reacting with the stream of fluent material 368 and/or stream or molten fluent material 370 thereby preventing the above-noted prior art problem of combustion, oxidation, etc. of the material.

It will be further understood that the internal baffle 342 is of generally conical shape or configuration, tapering radially inwardly in the direction of the flow of the molten material 370 and is for concentrating the stream of heated gas 362 and 364, and deflects or reflects heat from the burner 320 and heat capacitor 330 to enhance melting of the heat fusible fluent material 368. Further, it will be understood that the heat capacitor 330 is for storing heat for enhancing production of the stream of heated gas 362 and 364.

Still further, it will be understood by reference to FIG. 11 that the heat capacitor 330 and baffle or flame barrier 340 are spaced apart with an intermediate portion of the concentric tubes 346 and 348 extending therebetwen and it will be understood that the housing 312, heat capacitor 330, and flame barrier 340 collectively provide an annular heat zone indicated by numerical designation 380, surrounding the intermediate portion of the concentric tubes, which heat zone applies heat to the fluent heat fusible material passing through the intermediate portion of the tube 348 to warm the material prior to advancing into the stream of heated gas 362 and 364 to enhance melting of the material.

With particular regard to the concentric tubes 346 and 348, it will be understood that, as shown in FIG. 11, the tubes are separated by an annular air space of sufficient size to dissipate enough heat to cool the inner tube 348 and insulate the inner tube from the outer tube to impede heat transfer from the heat zone 380 sufficient to melt the stream of heat fusible fluent material 368 while passing through the inner tube 348 thereby preventing tube clogging.

Lastly with regard to thermal spray apparatus 310, it will be understood that the housing 312 confines the stream of heated gas 362–364 to facilitate transfer of heat from the stream of heated gas to the stream of heat fusible fluent material 368 to enhance melting thereof.

Figure 12:
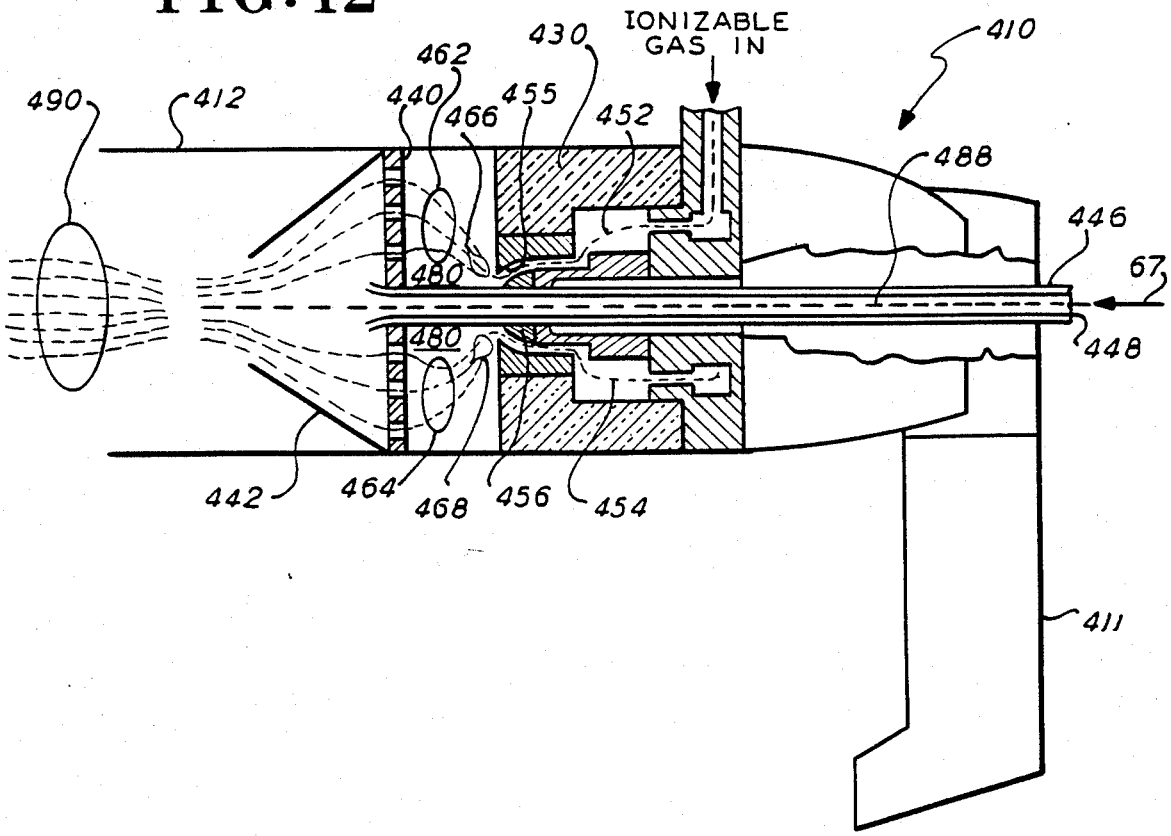
FIG. 12 is a diagrammatical illustration, in side elevational view, in cross-section, of a further alternate embodiment of the present invention wherein a stream of heated gas is produced by passing a stream of ionizable gas between two electrodes which support an arc which heats and ionizes the gas stream thereby effecting a plasma.

Shown in FIG. 12 is a further alternate embodiment of the present invention utilizing plasma to provide thermal spray apparatus in accordance with the teachings of the present invention. Such thermal spray apparatus is indicated by general numerical designation 410 and, as will be understood by reference to FIG. 12, such apparatus is hand-held apparatus including a handle 411, a housing 412, a flame barrier 440, and a pair of concentric feed tubes 446 and 448. A plasma or stream of heated gas is indicated collectively by dashed lines 462 and 464 and such plasma or stream of heated gas is produced or effected by passing a stream or streams of ionizable gas 452 and 454 between two electrodes, anode 455 and cathode 456 which support an arc (flame in the context of the present invention as noted above) indicated diagrammatically at 466 and 468 to produce the stream of plasma or heated gas 462 and 464. A stream of heat fusible fluent material indicated by dashed line 488, from a suitable source thereof such as source 60 of FIGS. 1 and 3, is advanced from the source through inner concentric tube 448 and into the stream of heated gas or plasma 462 and 464 to melt the material and produce a stream of molten fluent material indicated collectively by dashed lines 490 which is for being directed or sprayed onto a substrate and which, upon hardening and as noted above, coats the substrate. As shown in FIG. 12, thrmal spray apparatus 410 may further include an internal baffle 442 substantially identical in shape and purpose as the internal baffle 342 of FIG. 11 and as described above.

Similar to the flame barrier 30 of FIG. 11, flame barrier 440 of FIG. 12 is provided with a plurality of annularly arranged and radially disposed apparatus, such as shown in cross-section, for permitting passage therethrough of the stream of heated gas or plasma 462 and 464 for preventing the arc 466 and 468 (flame) from reacting with the stream of heat fusible material 490. Similarly, the heat capacitor 430 is for storing heat produced by the plasma to enhance melting of the heat fusible material.

Further similarly with regard to the thermal spray apparatus of FIG. 11, the concentric feed tubes 446 and 448 are separated by an annular air space as shown and for the same purpose as described above with regard to the concentric tubes 446 and 448 of FIG. 11, and still further similarly flame barrier 440, heat capacitor 430, and housing 412 cooperatively provide a heat zone 480 surrounding an intermediate portion of the concentric tubes 446 and 448 of the same purpose as heat zone 380 of FIG. 11 as is also described above.

It will be further understood by those skilled in the art that the plasma thermal spray apparatus 410 of the present invention, with regard solely to the production or effecting of a plasma, may be of the same general type as the plasma gun of U.S. Pat. No. 3,935,418 identified above and of the same general type as the plasma spray device disclosed in U.S. Pat. No. 3,676,638 issued July 11, 1972, Mille Stand inventor, also assigned to the Sealectro Corporation.

Although no cooling means are illustrated in the various embodiments of the thermal spray apparatus of the present invention described above and shown in the drawings, it will be understood that such apparatus generate considerable heat so cooling means will be generally part of such apparatus; such cooling apparatus are old in the art.

It will be further understood by those skilled in the art that many variations and modifications may be made in the present invention without departing from the spirit and the scope thereof and that the above described preferred embodiment is merely illustrative of the present invention.

What is claimed is:

1. Thermal spray apparatus for providing a stream of molten heat fusible fluent material for coating a substrate, comprising:

heat source means including a flame for producing a stream of heated gas heated to sufficiently high temperature to melt said material;

material advancing means for advancing a stream of heat fusible fluent material into said stream of heated gas to melt said material and produce said stream of molten fluent material; and flame barrier means intermediate said flame and said stream of molten fluent material, said flame barrier means for permitting passage therethrough of said stream of heated gas and for preventing reaction between said flame and said material.

2. Thermal spray apparatus according to claim 1 further including housing means surrounding said heat source means, said material advancing means and said flame barrier means and for confining said stream of heated gas to facilitate transfer of heat from said stream of heated gas to said stream of heat fusible fluent material to melt said material.

3. Thermal spray apparatus according to claim 2 wherein said material advancing means comprise material feed tube means extending through said heat source means, said flame barrier means and partially through said housing means and wherein said flame barrier means is for preventing reaction between said flame and said material upon said material exiting said feed tube means.

4. Thermal spray apparatus according to claim 3 wherein said feed tube means comprise concentric inner and outer tubes spaced apart and separted by an air space to prevent melting of said stream of heat fusible fluent material within said feed tube means, said stream of heat fusible fluent material passing through the inner tube.

5. Thermal spray apparatus according to claim 4 wherein said apparatus further includes heat capacitor means for storing heat for enhancing producing of said stream of heated gas, and wherein said material feed tube means also extends through said heat capacitor means.

6. Thermal spray apparatus according to claim 5 wherein said housing means, said flame barrier means, and said heat capacitor means are generally annular in shape and wherein said flame barrier means are provided with a plurality of generally radially disposed apertures through which said stream of heated gas passes.

7. Thermal spray apparatus according to claim 6 wherein said heat capacitor means and said flame barrier means are spaced apart with an intermediate portion of said feed tube means extending therebetween, and said housing, said heat capacitor and said flame barrier means collectively providing a heat zone surrounding said intermediate portion of said feed tube means for applying heat to said fluent heat fusible material passing through said intermediate portion to warm said material prior to said advancing into said stream of heated gas to enhance melting of said material.

8. Thermal spray apparatus according to any one of the preceding claims wherein said stream of molten material has a direction of flow and wherein said apparatus further comprises an internal baffle surrounding said material advancing means and of generally conical shape tapering inwardly in said direction of flow and for concentrating said stream of heated gas to enhance melting of said material and for forming said stream of molten heat fusible fluent material into a predetermined spray pattern.

9. Thermal spray apparatus according to claim 1, 2, 3, 4, 5, 6 or 7 wherein said heat source means comprise a burner for the combustion of inflammable gas to produce said stream of heated gas.

10. Thermal spray apparatus according to claim 1, 2, 3, 4, 5, 6 or 7 wherein said heat source means comprise means effecting plasma by passing an ionizable gas between two electrodes which support an arc to heat and ionize said gas to produce said stream of heated gas.

11. Thermal spray apparatus according to claim 1 wherein said flame barrier means are non-magnetic mechanical flame barrier means.

* * * * *